United States Patent [19]

Siebert

[11] Patent Number: 4,769,980

[45] Date of Patent: Sep. 13, 1988

[54] YARN TWISTING APPARATUS

[75] Inventor: Georg Siebert, Hückeswagen, Fed. Rep. of Germany

[73] Assignee: Artec Design GmbH, Remschied, Fed. Rep. of Germany

[21] Appl. No.: 912,970

[22] Filed: Sep. 29, 1986

[30] Foreign Application Priority Data

Sep. 28, 1985 [DE] Fed. Rep. of Germany ..... 3534691
Oct. 5, 1985 [DE] Fed. Rep. of Germany ..... 3535613

[51] Int. Cl.[4] ..... D01H 7/86; D01H 1/10; D02G 3/28

[52] U.S. Cl. ..... 57/58.52; 57/58.83; 57/58.86; 57/59

[58] Field of Search ..... 57/58.3–58.63, 57/58.83–58.86, 315, 59–66

[56] References Cited

U.S. PATENT DOCUMENTS 4,606,181 8/1986 Lappage et al. ..... 57/58.86 X

FOREIGN PATENT DOCUMENTS 8405365 5/1984 Fed. Rep. of Germany .

*Primary Examiner*—John Petrakes
*Attorney, Agent, or Firm*—Bell, Seltzer, Park & Gibson

[57] ABSTRACT

A yarn twisting apparatus is disclosed which comprises a central spindle and a coaxially disposed yarn package carrier. A central wheel is fixedly mounted to the spindle, and the spindle and yarn package carrier are mounted for relative rotation about the axis of the spindle. Also, an offset yarn guide is mounted to the yarn package carrier, and such that a yarn may be withdrawn from a package mounted on the yarn package carrier, and looped about the central wheel and then around the offset yarn guide. In one embodiment, a withdrawal force is applied to the yarn which causes the central wheel and offset yarn guide to relatively rotate and impart twist to the yarn, and in other embodiments one of the members is driven to impart the relative rotation. Embodiments are also disclosed for imparting a double twist to the yarn.

8 Claims, 5 Drawing Sheets

YARN TWISTING APPARATUS

FIELD OF THE INVENTION

This invention relates generally to a yarn twisting apparatus and more particularly to such an apparatus in which the yarn twisting element of the twisting apparatus is rotated in response to yarn being withdrawn from yarn supply packages and engaging the twisting element in its path of travel through the twisting apparatus.

BACKGROUND OF THE INVENTION

In the normal process of imparting twist to yarn, it is necessary that the speed of travel of the advancing yarn and the rotary speed of the twisting spindle be coordinated so that the twisting spindle is rotated at a predetermined ratio relative to the speed of travel of the advancing yarn. This twisting process requires a yarn conveying or withdrawing system which is driven at a definite speed, and a twisting spindle which is also driven at a definite speed relative to the speed of the advancing yarn. The speed ratio between the yarn conveying or advancing system and the twisting spindle may be adjustable and the two drive systems are operatively interconnected, either mechanically or electrically. However, the two separate drive systems and the interconnection therebetween add to the engineering and constructional cost involved in producing the twisting apparatus and is not necessary for certain uses of the twisting apparatus, as for example, disclosed in German Utility Model Gbm No. 84 05 365.

It is accordingly an object of the present invention to provide a yarn twisting apparatus which achieves a fixed ratio between the yarn withdrawal speed and the twisting spindle speed, and which imparts a definite and predetermined amount of twist (turns per meter) to the yarn.

SUMMARY OF THE INVENTION

The above and other objects and advantages of the present invention are achieved in the embodiments illustrated herein by the provision of a yarn twisting apparatus which comprises a spindle defining a central axis, a yarn package carrier positioned adjacent the central axis, a central wheel positioned coaxially about the central axis, and an offset yarn guide positioned so as to be laterally offset from the central axis and adjacent the central wheel. One of the central wheel and the offset yarn guide is mounted so as to preclude its free rotation about the central axis, and the other of these members is mounted for free rotation about the central axis. By this arrangement, a yarn may be withdrawn from a package mounted on the yarn package carrier, and looped about the central wheel and then around the offset yarn guide. In one embodiment, the withdrawal force applied to the yarn corresponds to the rotational momentum which causes the central wheel and offset yarn guide to relatively rotate and impart twist to the yarn. In another embodiment, a suitable drive is provided for relatively rotating the central wheel and offset yarn guide.

When the yarn package carrier is rotatable, the central wheel is stationary. When the yarn package carrier is stationary, such as for example in a flyer twisting device, or when it "floats" such as in a double twisting device, the central wheel is mounted so as to be rotatable with the central spindle.

The twisting apparatus of the present invention can be applied to both single and double twisting devices. In the first and most preferred embodiment of the present invention, the drive of the twisting device is basically derived from the fact that the rotating spindle of the twisting device obtains its driving motion by the yarn itself. To this end, the yarn is guided around the central wheel which is concentric to the spindle axis and the central wheel is rotated because the yarn being withdrawn from the central wheel is under a greater tension than the yarn being withdrawn from the yarn package and advancing to the central wheel. In the second alternative of the invention, the withdrawal force of the yarn is basically derived from the fact that the spindle and the package carrier are rotated relatively to each other by means of a motor.

When the double twisting principle is applied, the spindle is hollow and the central wheel is located at the entry end of the hollow spindle so that the yarns advancing from the floatingly supported, that is stationary, yarn supply package carrier are guided around the central wheel and then into the spindle. However, in the application of the double twisting principle, the central wheel can also be stationarily positioned at the exit end of the hollow spindle and the offset yarn guide is then rotated about the spindle. In any event, only one drive system is required and this single drive is provided for withdrawing the yarn from the yarn supply package. The positive withdrawal or advancement of the yarn simultaneously imparts rotation to one of the twisting elements. In the alternative, one of the twisting elements can be driven and the rotation of the twisting element will simultaneously cause the yarn to be withdrawn from the yarn supply package so that in both alternatives only one drive is necessary to either rotate the twisting element or to withdraw the yarn.

BRIEF DESCRIPTION OF THE DRAWINGS

Some of the objects and advantages of the present invention having been stated, others will appear as the description proceeds when taken in connection with the accompanying drawings, in which.

DESCRIPTION OF THE ILLUSTRATED EMBODIMENTS

Figure 1:
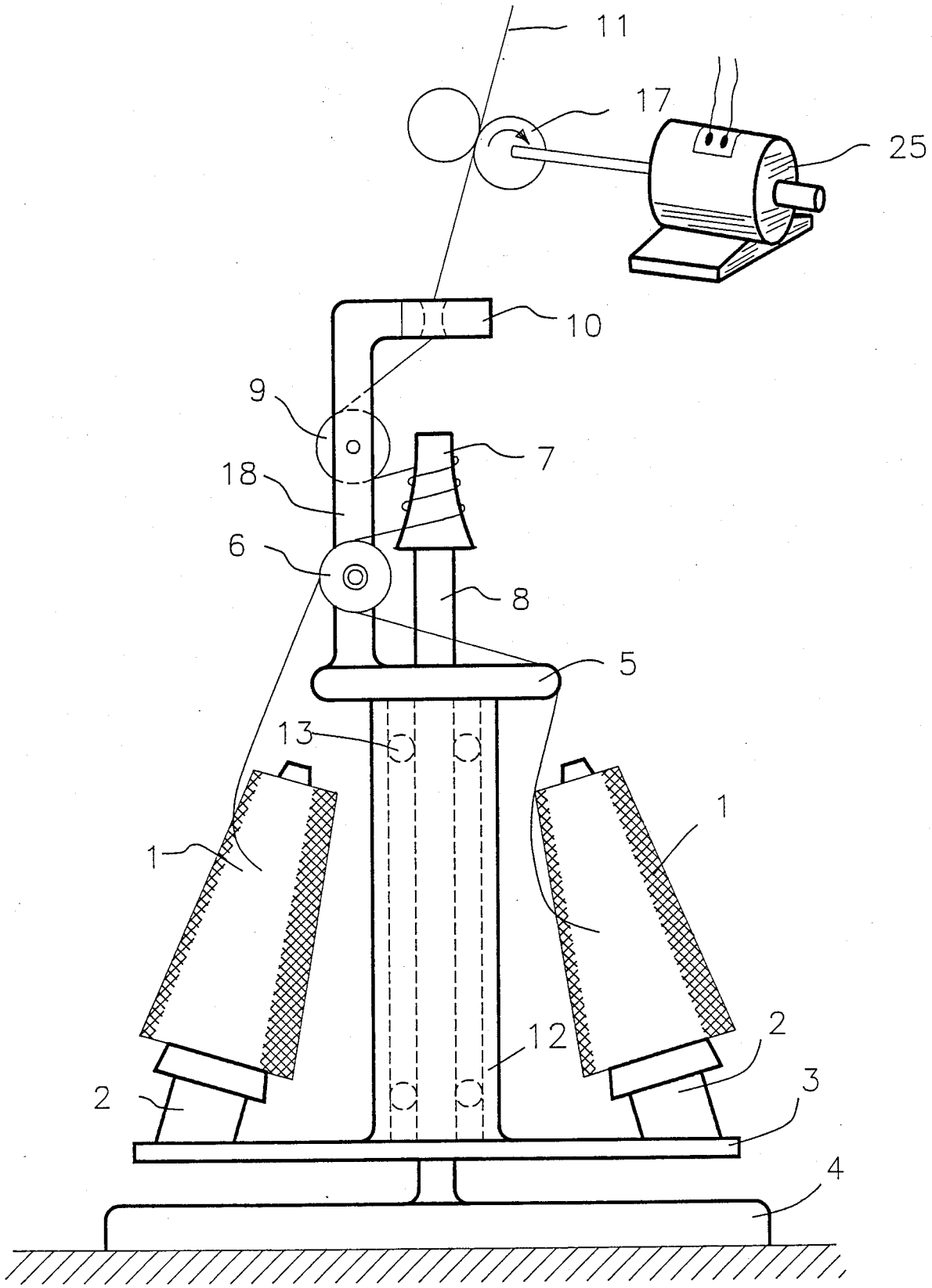
FIG. 1 is a side elevational view of an embodiment of the present yarn twisting apparatus, particularly adapted for single twisting.
Figure 1A:
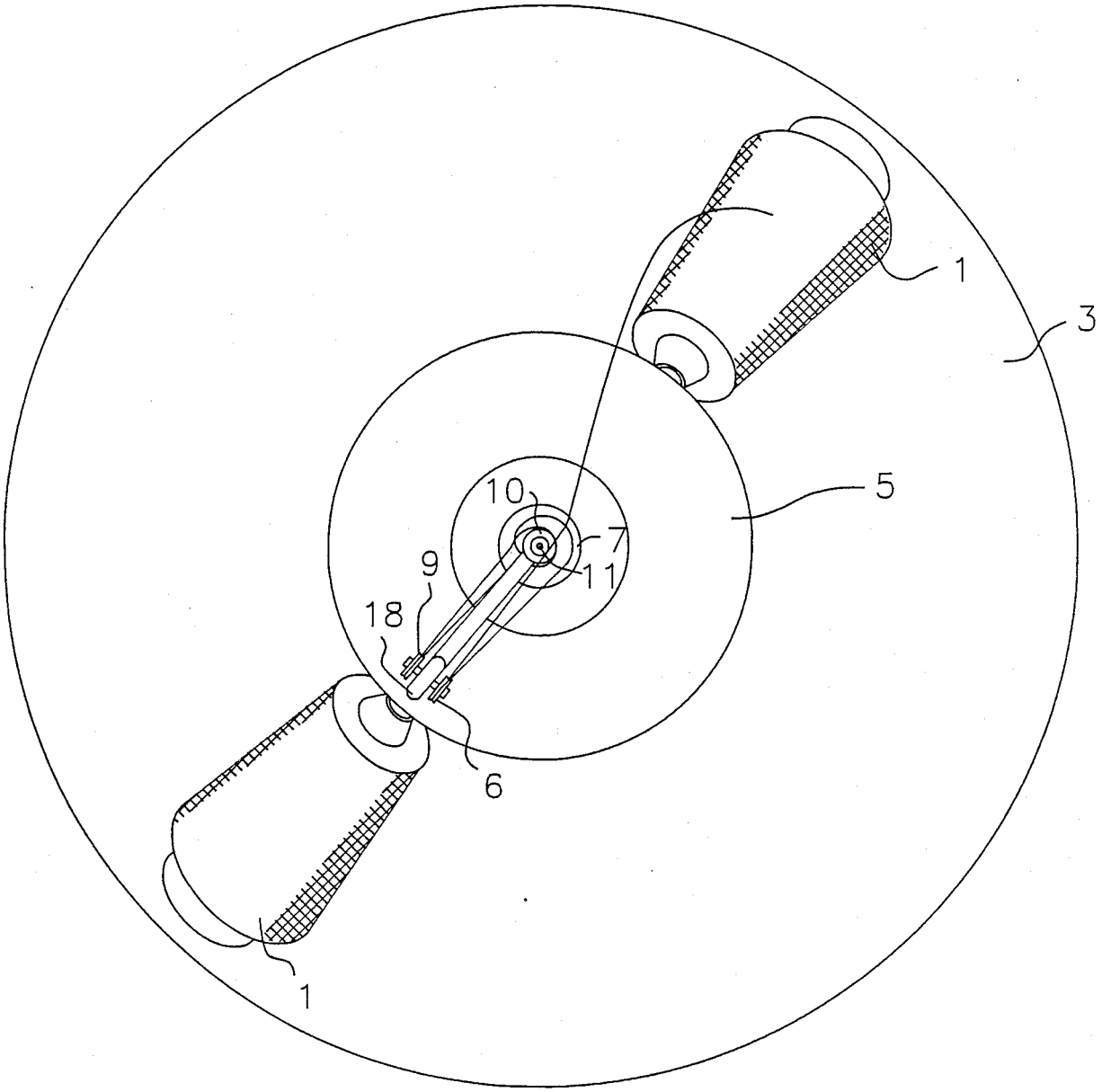
FIG. 1A is the top view of the device of FIG. 1 with the feed rollers 17 and the motor 25 omitted.

The yarn twisting apparatus illustrated in FIGS. 1 and 1A is of the single twisting type in which a twisted yarn 11 is produced from several single yarns withdrawn from yarn feed or yarn supply packages 1. The yarn supply packages 1 are positioned on yarn package supports or holders 2 spaced around a yarn supply package carrier 3. The carrier 3 is rotatably supported by upper and lower bearings 13 on a vertically extending central spindle 8, which is fixed at its lower end on a stationary stand 4, and which defines a vertical central axis. A vertical tubular shaft 12 is fixed to the carrier 3 so as to be coaxial with the central axis, and a concentric yarn guide, in the form of a circular disk 5, is fixed on the upper end of the vertical shaft 12. The yarn from one of the yarn supply packages 1 is guided across the circular yarn guide 5 and then passes around a rotating wheel type of yarn guide 6, where the yarn being withdrawn from the other yarn supply package 1 is combined therewith.

The combined yarn is then looped one or several times around a central wheel 7, in the form of a tapered body of generally conical configuration. The central wheel 7 is fixed on the upper end of the stationary central spindle 8 and is coaxial with the central axis. The combined yarn leaving the central wheel 7 is guided through and around an-offset rotating wheel type of yarn guide 9 supported for rotation on the rotatable carrier 3 by an upwardly extending extension bracket 18, which is fixed at its lower end on the circular yarn guide 5 and so as to rotate with the carrier 3 about the central axis.

A central yarn guide 10 is provided on the upper end of the extension bracket 18 and is located so as to be concentric with the central axis and the central wheel 7, and it is spaced from and in alignment with the central spindle 8. The twisted yarn is withdrawn through the central yarn guide 10 by a yarn delivery drive system, illustrated as feed rolls 17, rotated by a motor 25. However, it is to be understood that the twisting apparatus may be operated by hand and in this case it is possible to withdraw the twisted yarn by hand through the central yarn guide 10.

In any event, as the combined yarn is withdrawn either by hand or by the delivery rolls 17, the carrier 3 is rotated because of the fact that the tension in the yarn which advances to the central wheel 7 from the yarn supply packages 1 is less than the tension of the yarn leaving the central wheel 7. The tension force is applied to the offset yarn guide 9 to thereby impart a moment of rotation to the carrier 3. This rotation of the carrier 3 causes the yarn advancing from the yarn combining guide 6 to wind around the central wheel 7 and to unwind from the central wheel 7 as it leaves the same. Thus, the rotary speed of the carrier 3 is directly proportional and at a predetermined ratio to the speed of the advancing yarn. The selection of a central wheel 7 with a different diameter provides a different twist ratio.

While the combined yarn is illustrated as being wound or looped around the central wheel 7 in a counterclockwise direction, it is to be understood that the combined yarn could be wrapped or looped around the central wheel 7 in the reverse or clockwise direction. The central wheel 7 is of a slightly conical or hyperbolic shape so that the individual wraps or winds of the combined yarn are maintained in spaced-apart relationship as the yarn is wound onto and unwound from the central wheel 7.

Figure 2:
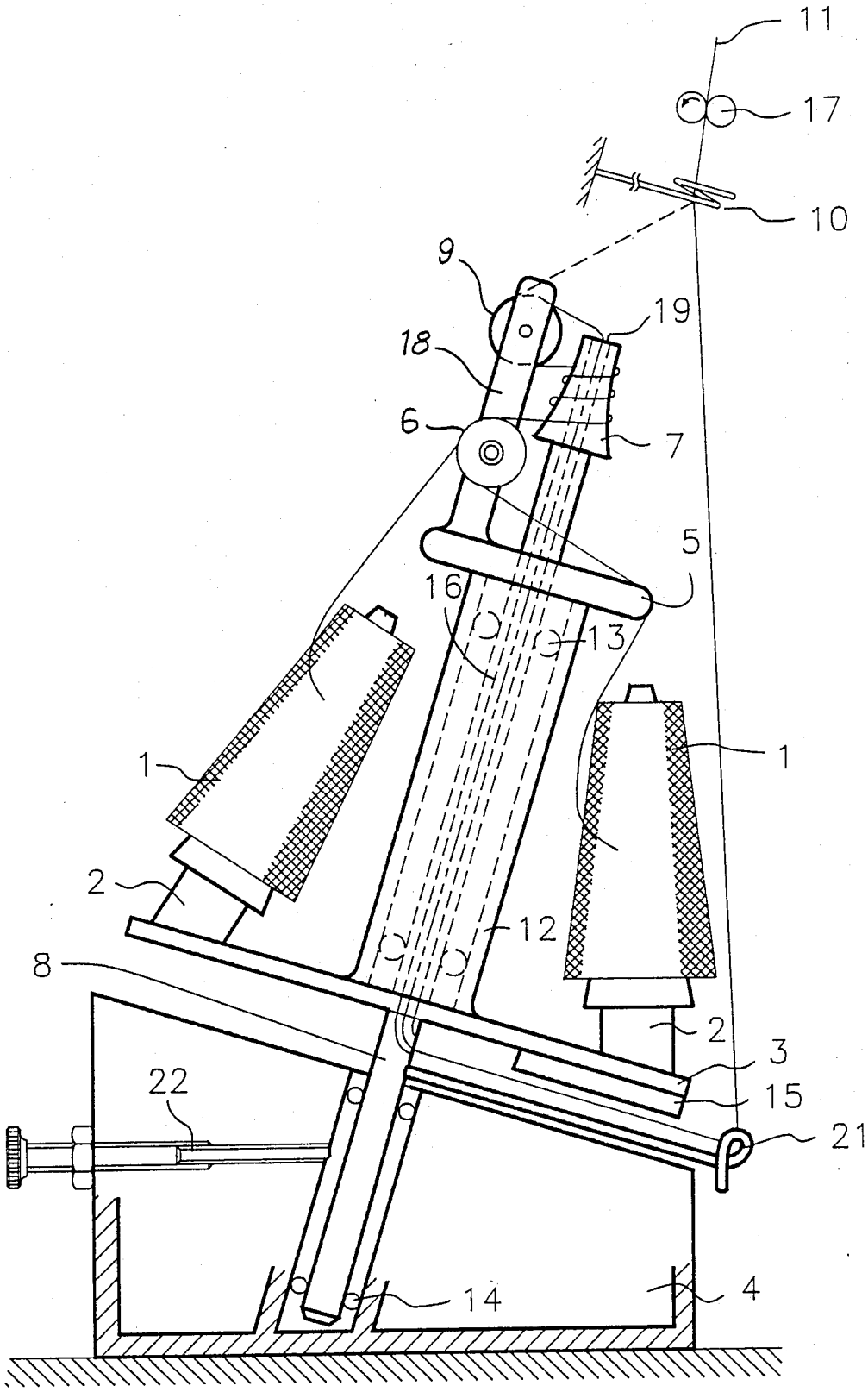
FIG. 2 is a side elevational view, with parts in section, illustrating a second embodiment of the present yarn twisting apparatus, which may optionally operate by the single or double twisting method.

The twisting apparatus illustrated in FIG. 2 can be selectively operated in accordance with the double twisting or the single twisting principle. Many of the parts illustrated in FIG. 2 are similar to corresponding parts of the first embodiment of FIG. 1 and bear the same reference numerals. In this embodiment, the central spindle 8 is hollow throughout a substantial portion of its length and is supported at its lower end in spaced-apart upper and lower bearings 14 for rotation about the central axis, which in this case is inclined somewhat from the vertical. A central wheel 7 is fixed on the upper end of the central spindle 8. A yarn supply package carrier 3 is rotatably supported in spaced-apart upper and lower bearings 13 on the central spindle 8. However, the carrier 3 is prevented from rotating because the spindle is supported at an oblique upward angle and a weight 15 is attached to one side of the carrier 3. The weight 15 can be eliminated when the mass of the carrier 3 is unevenly distributed, such as by a non-uniform shaping the carrier 3 or by a non-uniform distribution of the yarn feed packages 1. The yarn packages 1 are supported on yarn package supports 2 spaced apart around the carrier 3.

The yarn being unwound from one of the yarn feed packages 1 is guided over a circular disk type of yarn guide 5 and then around an initial rotating wheel type of yarn guide 6 where it is combined with the yarn being withdrawn from the other yarn supply package 1. The combined yarn is then looped several times around the central wheel 7. As the combined yarn unwinds from the central wheel 7, it passes around a rotating wheel type of offset yarn guide 9 and into a yarn entry opening 19 of the hollow center of the twisting spindle 8. At an outlet opening 20 of the hollow spindle 8 there is fixed the inner end of an outwardly extending yarn guide arm 21 which rotates with the hollow spindle 8. The combined yarn exiting from the hollow spindle 8 passes through a guide eye at the end of the rotating yarn guide arm 21 and is guided to a central yarn withdrawing guide 10 which is mounted in a fixed position. It is preferable that the yarn guide 10 be supported concentrically with and axially spaced from the central spindle 8, as illustrated in FIG. 2. The combined twisted yarn 11 is withdrawn through the delivery rolls 17 which are suitably driven by a motor (not shown here), or by a winder of any other suitable withdrawing means. As in the first embodiment, the delivery rolls 17 may be eliminated when the twisting apparatus is hand operated, i.e. the yarn is withdrawn by hand, e.g. by the hand knitting operation.

As the combined yarn is withdrawn by hand or by the delivery rolls 17, the twisting spindle 8 is rotated with the revolving yarn guide arm 21. By this motion, the combined yarn is imparted two twists per revolution or rotation of the spindle 8. The number of twists imparted is at a predetermined ratio to the speed of the yarn being withdrawn and this ratio is dependent on the diameter of the central wheel 7. By utilizing central wheels 7 with different diameters, it is thus possible to obtain a different number of twists for a particular speed of withdrawal of the yarn. Also, the direction of twist can be reversed by winding the combined yarn in the opposite direction around the central wheel 7. Here again, the twisting of the yarns results from the fact that the yarn unwinding from the central wheel is under a higher tension than the yarn being withdrawn from the supply packages 1 and being advanced thereto.

In the embodiment illustrated in FIG. 2, the twist ratio can be reduced by operating the apparatus as a single twister. To utilize the twisting apparatus as a single twister, a threaded locking screw 22 is provided to be moved into locking engagement with the spindle 8 and prevent the same from rotating. The weight 15 is also removed so that the mass on the carrier 3 is symmetrically distributed. The yarn is then threaded, as indicated by the dashed line extending from the offset guide 9 directly to the central yarn guide 10 where it is withdrawn by the delivery rolls 17. With the combined yarn being withdrawn directly from the offset guide 9 to the central yarn guide 10, the carrier 3 is rotated and the yarn receives one twist per rotation of the carrier 3. The direction of the twist can be reversed by changing the direction of the looping or wrapping of the combined yarn around the central wheel 7. Also, it is possible to change the ratio of twist insertion by selecting central wheels 7 with a different diameter.

Figure 3:
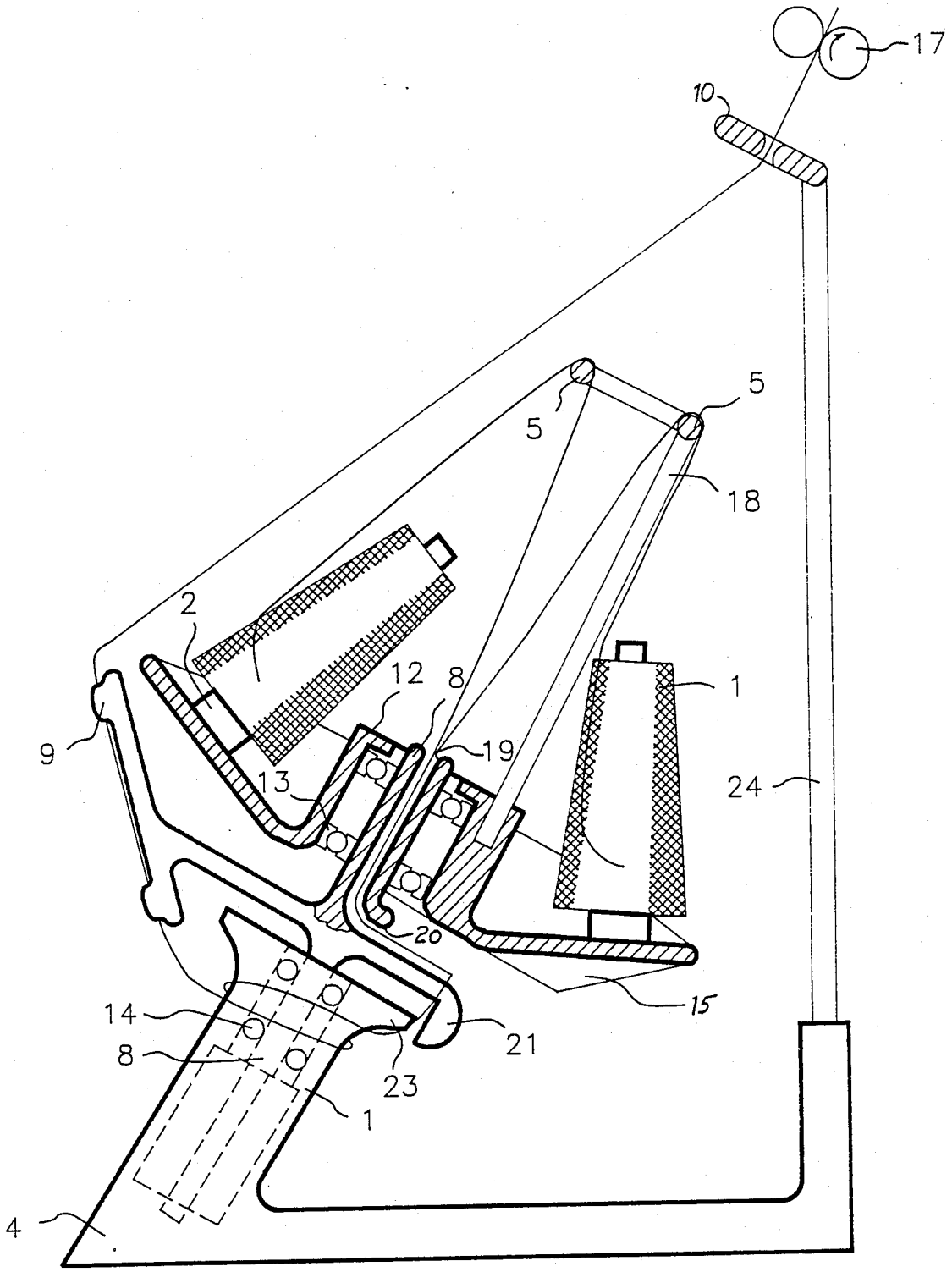
FIG. 3 is a side elevational view, with parts in section, of a third embodiment of the present yarn twisting apparatus, which operates by the double twisting method.

The embodiment of the yarn twisting apparatus illustrated in FIG. 3 is shown as being operated in a double twisting operation, and the parts illustrated in FIG. 3 which correspond to the parts illustrated in FIGS. 1 and 2 bear the same reference numerals. In this embodiment, the central spindle 8 is supported for rotation in a fixed stand 4 by spaced-apart bearings 14. The carrier 3 is rotatably supported on the central spindle 8 by means of spaced-apart bearings 13. However, the carrier 3 is prevented from rotation because the spindle 8 is supported at an angle and a weight 15 is attached to one side of the carrier 3. The weight 15 can be eliminated when the mass of the carrier is unevenly distributed, for example by shaping the carrier plate 3 or by a rotationally asymmetrical distribution of the feed yarn packages 1. Also, the weight 15 can be replaced by a pair of magnets, one of which is attached to the carrier 3 and the other fixed on a fixed portion of the stand 4 and as close as possible to the magnet on the twisting plate 3. It is also to be understood that this magnet arrangement may be utilized to replace the weight 15 in the embodiment of FIG. 2.

The feed yarn packages 1 are supported on holders 2 fixed on the carrier 3 so that the yarns are withdrawn from the supply packages and over an annular yarn guide 5. The annular yarn guide 5 is supported concentrically above the spindle 8 by an extension bracket 18, the lower end of which is fixed on the carrier 3. The yarns are combined as they enter the entrance opening 19 of the hollow spindle 8 and guided therethrough. Attached at the outlet opening 20 of the spindle 8 is a yarn guide surface 21 which rotates along with the spindle 8. An offset yarn guide 9 is fixed to the spindle 8 at a location adjacent the outlet opening 20, and the yarn guide surface 21 is disposed oppositely from the offset yarn guide 9 and it encloses the upper edge 23 of the central wheel 7 which is arranged in a stationary and concentric position relative to the spindle 8 and extends upwardly from the stand 4. The combined yarn advancing from the outlet 20 of the spindle 8 is, therefore, guided in an axial direction around the yarn guide surface 21 and from there to the central wheel 7.

The central wheel 7 is tapered downwardly and the diameter decreases from its upper edge 23 downwardly. The combined yarn is looped once or twice around the central wheel 7 and then guided onto and through the offset guide 9, which is so arranged that the yarn can be guided therefrom directly to a stationary central yarn guide 10. The stationary yarn guide 10 is supported in a fixed position above the spindle and in alignment therewith on the upper end of a vertical support rod 24, the lower end of which is fixed on the stand 4. Alternatively, the spindle 8 can be driven. The offset yarn guide 9 extends outwardly beyond the yarn package carrier 3 so that the combined yarn is guided upwardly to the central yarn guide 10 and outside of the yarn supply packages 1 which are supported on the carrier 3.

Figure 4:
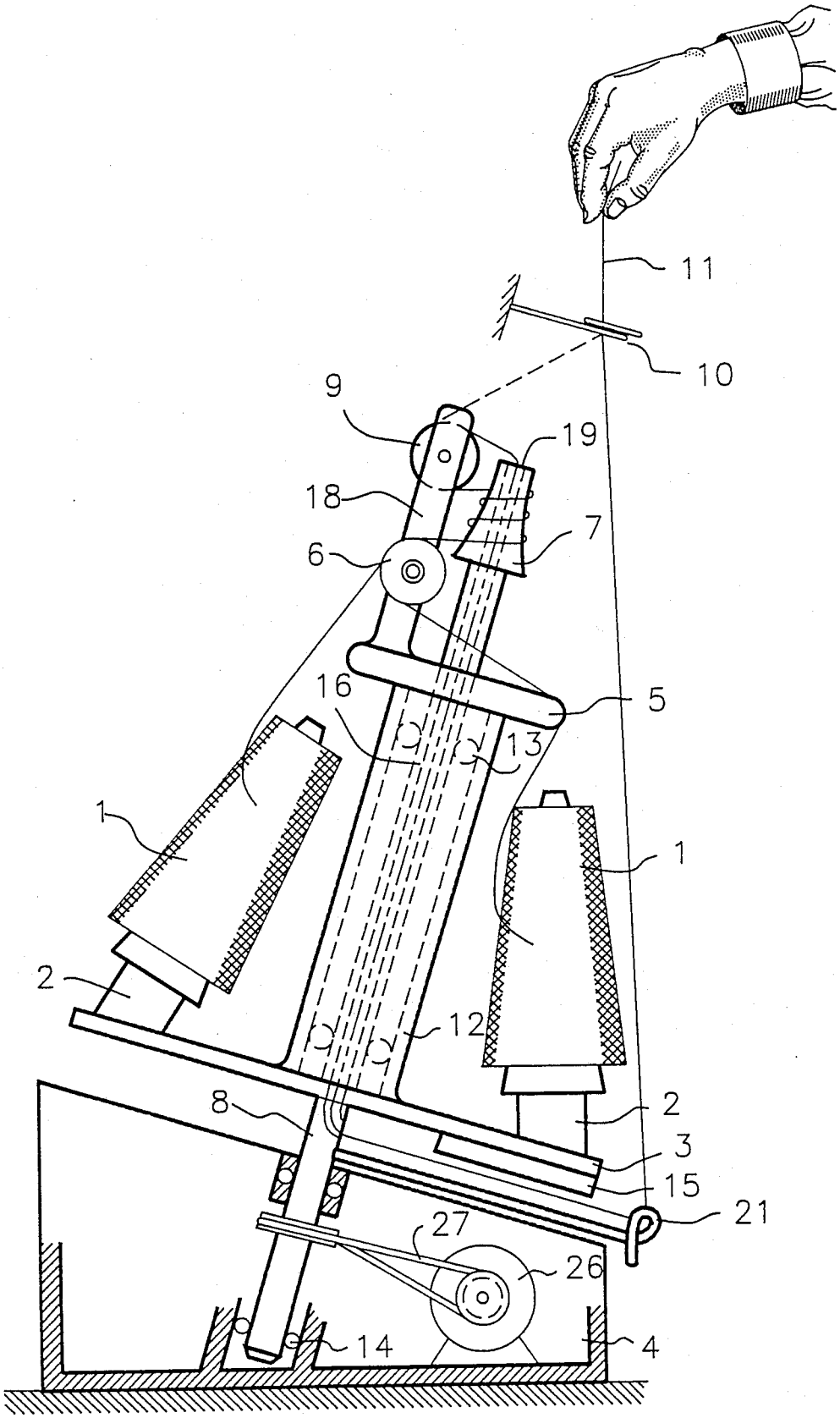
FIG. 4 is similar to FIG. 2; however, the spindle is driven by a motor.

Since the combined yarn advancing from the central wheel 7 is under a greater tension than the combined yarn advancing thereto, and the yarn guide 9 is offset relative to the spindle 8, the yarn exerts a torque on the spindle 8 and thereby rotates the same. As a result, the combined yarn balloons around the yarn supply packages 1 and imparts two twists thereto upon each spindle revolution. The speed of the withdrawn combined yarn and the speed of the spindle 8 are at a predetermined fixed ratio so that the yarn obtains a defined twist therein. The embodiment of FIG. 4 is similar to the one shown in FIG. 2 except that the twisted yarn 11 is shown being withdrawn by hand instead of the motor driven delivery rolls 17. The spindle is driven by a motor 26 via a transmission belt 27. Thereby, the yarn is withdrawn from the packages since it is wound on the central wheel 7. At the same time, it is unwound therefrom and twisted. As indicated, it is thus possible to withdraw the yarn by hand under very low tension.

In the drawings and specification there has been set forth the best modes presently contemplated for the practice of the present invention, and although specific terms are employed, they are used in a generic and descriptive sense only and not for purposes of limitation, the scope of the invention being defined in the claims.

That which I claim is:

1. A yarn twisting apparatus comprising a central spindle defining a central axis and mounted for rotation about said central axis, a yarn package carrier mounted coaxially about said central spindle, means mounting said yarn package carrier so as to preclude free rotation thereof about said central axis, a central wheel fixedly mounted to said central spindle and positioned coaxially about said central axis, an offset yarn guide mounted to said yarn package carrier and so as to be laterally offset from said central axis and adjacent said central wheel, a central yarn guide mounted in coaxial alignment with said central axis and axially spaced from said central wheel, and wherein said central wheel and said central yarn guide are both positioned on one side of said yarn package carrier, and wherein said central spindle is hollow and includes a yarn inlet opening adjacent said central wheel and a yarn outlet opening on the opposite side of said yarn package carrier, and a radially directed yarn guide arm mounted to said central spindle adjacent said outlet opening, whereby a yarn may be withdrawn from a package mounted on said yarn package carrier and looped about said central wheel and then around said offset yarn guide, and such that the yarn leaving said offset yarn guide may be fed into said inlet opening and through said central spindle and outwardly through said outlet opening to said yarn guide arm, and then to send central yarn guide, and such that said central wheel and said offset yarn guide are adapted to relatively rotate and impart twist to the yarn being withdrawn.

2. The yarn twisting apparatus as defined in claim 1 wherein said yarn package carrier includes a plurality of yarn package supports positioned along a circle about said central axis, and such that the yarn from a plurality of packages mounted on said supports may be combined and twisted together.

3. The yarn twisting apparatus as defined in claim 1 further comprising drive means for positively rotating said spindle and central wheel.

4. The yarn twisting apparatus as defined in claim 1 wherein said central axis is inclined from the vertical, and said means mounting said yarn package carrier so as to preclude free rotation thereof about said central axis comprises weight means mounted to said yarn package carrier so as to be offset from said central axis.

5. A yarn twisting apparatus comprising a central hollow spindle defining a central axis and having a yarn inlet opening and a yarn outlet opening therein, means mounting said hollow spindle for rotation about said central axis, a yarn package carrier, means mounting said yarn package carrier coaxially about said spindle and so as to preclude the free rotation of said carrier about said central axis, and such that said inlet opening is on one side of said carrier and said outlet opening is on the other side of said carrier, a central wheel fixedly mounted about said central axis and being positioned adjacent said yarn outlet opening, an offset yarn guide fixedly mounted to said spindle and so as to be laterally offset from said central axis and adjacent said central wheel, initial yarn guide means mounted to said yarn package carrier for guiding a yarn withdrawn from a package mounted on said yarn package carrier into said inlet opening of said spindle, and whereby a yarn may be withdrawn from a package mounted on said yarn package carrier and advanced into said inlet opening, through said spindle and outwardly through said outlet opening, and then looped about said central wheel and then around said offset yarn guide, and such that said central spindle and said offset yarn guide are adapted to relatively rotate and impart twist to the yarn being withdrawn.

6. A yarn twisting apparatus as defined in claim 5 further comprising a yarn guide surface mounted to said spindle adjacent said outlet opening for guiding a yarn from said outlet opening to said central wheel.

7. A yarn twisting apparatus as defined in claim 6 wherein said yarn guide surface is positioned on the side of said spindle opposite said offset yarn guide.

8. A yarn twisting apparatus as defined in claim 7 further comprising a central yarn guide fixedly mounted in coaxial alignment with said central axis on said one side of said yarn package carrier, and so that the yarn may be advanced through said central yarn guide after having passed through said offset yarn guide.

* * * * *